US006278241B1

(12) United States Patent
Enguelcht et al.

(10) Patent No.: US 6,278,241 B1
(45) Date of Patent: Aug. 21, 2001

(54) FOUR-NOZZLE PLASMA GENERATOR FOR FORMING AN ACTIVATED JET

(75) Inventors: Vladimir Enguelcht, Bishkek (KG); Pavel Koulik; Evgenia Zorina, both of Valeyres s/Montagny (CH); Stanislav Begounov, Yverdon-les-Bains (CH); Rudolph Konavko, Valeyres s/Montagny (CH); Anatolii Saitschenko; Mikhail Samsonov, both of Yverdon-les-Bains (CH); Ioulia Tsvetkova, Yverdon-les-Bains (CH)

(73) Assignee: TePla AG, Kirchheim bei Munich (DE)

( * ) Notice: Subject to any disclaimer, the term of this patent is extended or adjusted under 35 U.S.C. 154(b) by 0 days.

(21) Appl. No.: 09/068,706

(22) PCT Filed: Nov. 12, 1996

(86) PCT No.: PCT/CH96/00401

§ 371 Date: Nov. 23, 1998

§ 102(e) Date: Nov. 23, 1998

(87) PCT Pub. No.: WO97/18692

PCT Pub. Date: May 22, 1997

(30) Foreign Application Priority Data

Nov. 13, 1995 (CH) ..... 3208/95

(51) Int. Cl.[7] ..... H05H 1/34

(52) U.S. Cl. ..... 315/111.21; 315/111.31; 315/111.41; 219/121.52; 313/231.51

(58) Field of Search ..... 315/111.21, 111.31, 315/111.41; 219/121.48, 121.52, 123; 313/231.31, 231.41, 231.51

(56) References Cited

U.S. PATENT DOCUMENTS 6,040,548 * 3/2000 Siniaguine ..... 315/111.21 X

FOREIGN PATENT DOCUMENTS

0368547 * 5/1990 (EP) .
0522842 A 1/1993 (EP) .
2678467 A 12/1992 (FR) .
2271044 * 3/1994 (GB) .

* cited by examiner

*Primary Examiner*—Justin P. Bettendorf
(74) *Attorney, Agent, or Firm*—Clifford W. Browning; Woodard, Emhardt, Naughton, Moriarty & McNett, Patent and Trademark Attorneys

(57) ABSTRACT

A four-nozzle plasma generator comprising two anode electrode chambers and two cathode electrode chambers connected to DC power sources and generating four plasma jets of which the shape and the path are determined by an external magnetic field system. The plasma jets converge on a central area into which the material to be processed is injected, in order to form a single plasma stream. The nozzles are symmetrically arranged on a hood which includes a flat water-cooled diaphragm provided with a central aperture.

6 Claims, 3 Drawing Sheets

FOUR-NOZZLE PLASMA GENERATOR FOR FORMING AN ACTIVATED JET

BACKGROUND OF THE INVENTION

The invention concerns a four-nozzle plasma generator for forming an activated jet.

This generator can be used in particular for surface treatment processes (sterilisation, cleaning, etching, modifying, depositing coatings and films), of disperse and solid state materials, and for obtaining chemical products in the field of electronics, the automotive industry, the food industry, medicine, chemistry, the manufacture of machines and tools, etc.

A four-nozzle plasma generator is known which comprises two anode and electrode chambers connected to DC power sources and generates four plasma jets whose shape and trajectory is dictated by an external magnetic field system, such that the plasma jets converge to form a single plasma stream of lowered temperature at the central zone, into which the chemical products and/or materials to be processed are introduced, than in the peripheral zones. This device is described in the document entitled <<Basis for implementation of the method for dynamic plasma treatment of the surface of a solid body>>P.P. Koulik et al. <<Plasmochimie 87", Moscow 1987, part 2, pp. 58 to 96.

The construction of the electrode chambers (anode and cathode) is described in the document entitled <<Twin jet plasmatron>>, I. I. Genbaiev, V.S. Enguelsht, Frounze 1983.

The advantage of this generator of the prior art is due firstly to the specific configuration of the plasma streams which form a plasma funnel, enabling efficient introduction and processing of different products. Secondly, the electric current passing through the plasma jet, heating it and activating it with minimum losses, in view of the absence of cooled walls, means that the device offers high performance in output.

This device can be used efficiently for surface sterilisation, cleaning, modifying, etching and depositing coatings and films. Practical application of this reveals the following disadvantages however:

1. The generation of jets and streams of plasma are accompanied by toroidal vortices. The resulting hot gas flow heats the parts of the electrode chambers and the fixing and supply elements on the one hand and causes substantial heat losses by thus reducing the generator efficiency. On the other hand, in certain cases, the degree of turbulence of the plasma stream is increased and there is a loss of products introduced into the central zone of the stream, generating harmful secondary effects in terms of the service life of the generator, as these products precipitate on the surface of the electrode chambers and of the fixing and supply elements. Plasma radiation, which is particularly high when chemical products are introduced into the plasma stream, is also a cause of superfluous heating of the various parts of the generator exposed to this radiation.
   The result of the simultaneous effect of the convection and radiation streams is, ultimately, that the service life of the generator is reduced due to superfluous temperature rise of its parts and the formation of layers of precipitates of low thermal conductivity, making cooling of these parts difficult.
   In addition, from time to time, the layers of precipitate break down and are carried away by the gas vortices, soiling the treated surfaces and the plasma stream itself, making the composition of the latter virtually uncontrollable.

2. Once the plasma stream has finished heating and activating the products introduced into it, its role then ends and its presence in the periphery of the activated product stream is no longer required. If the activated product is a gas (which is the case in many applications, in particular surface cleaning, etching, films depositing, surface modification), the presence of the original plasma in the periphery of the activated stream starts to hinder the efficiency of the surface treatment. In fact, the plasma, which is still hot, heats the treated surface, and this is generally to be avoided. In addition, the plasma becomes just a passive component on the surface. Not involved in interaction with the surface, the only acting particles being those which the plasma has activated and which reach the surface by diffusion. The residual plasma is an obstacle to this diffusion, proving an even greater hindrance as the efficient section of the corrected particles forming the plasma is, on average, of an order larger than that of the neutral particles (activated) and hence the presence of these particles substantially reduces the coefficient of diffusion of the activated particles, and thus the diffusion stream, and finally the efficiency of the treatment.

SUMMARY OF THE INVENTION

The purpose of the invention is to offer a four-nozzle plasma generator designed to obtain a jet of activated gas of controllable composition and stable form, with a long continuous service life and optimum action on the items to be treated.

To this effect the invention concerns a four-nozzle plasma generator comprising two anode electrode chambers and two cathode electrode chambers, connected to DC power sources and generating four plasma jets whose shape and trajectory are created by means of a system of external magnetic fields, such that the plasma jets form a single plasma stream with a central zone of lowered temperature in which the chemical component and/or materials to be treated are introduced, the electrode chambers of this generator being arranged in an enclosure into which a gas is introduced, this enclosure comprising a concave flange to which the electrode chambers are fixed and a first flat water-cooled diaphragm provided with a circular central aperture positioned at the point of convergence of the plasma jets from the electrode chambers and through which the current passes.

According to one embodiment, the generator has a second water-cooled diaphragm downstream of the first, with an aperture of variable diameter, smaller than that of the plasma stream, this diaphragm being fixed to the enclosure by means of a circular wall, enabling evacuation of part of the plasma and gases introduced into the enclosure.

The solution offered by the present invention consists in modifying the four-nozzle plasma generator of the prior art, in such a way as to create an activated stream of controlled composition and efficient action on the treated surface, whilst increasing the service life of the generator. This entails remedying the disadvantages of the known four-nozzle generator described above, i.e. eliminating the convection streams and reducing the radiation streams acting on the electrode chambers, their fixings and supply elements, whilst at the same time intensifying the action on the treated surface of the activated components of the stream created by the generator, and reducing the quantity of plasma reaching the surface to be treated.

BRIEF DESCRIPTION OF THE DRAWINGS

A description is give below of the generator according to the invention, with reference to the drawing in which.

1. Electrode chamber

Figure 1A:
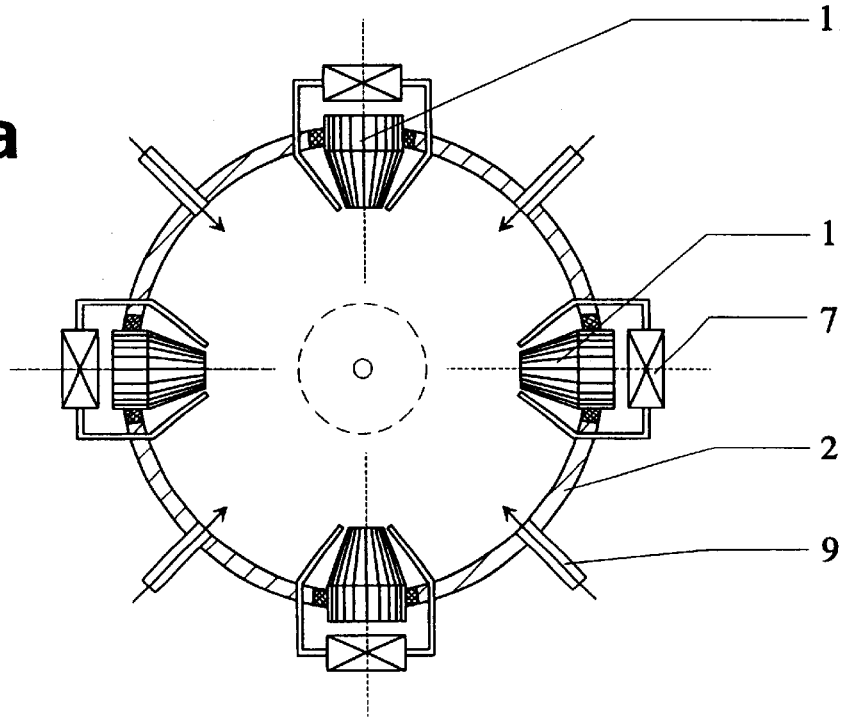
FIGS. 1*a* and 1*b* show a first example of the generator as per the invention, in a view from the side of the diaphragm (with the diaphragm shown in a broken line) and a lateral section, respectively; the references relating to these two figures are as follows.

2. Concave flange of the enclosure, water-cooled

3. Nozzle for introducing chemical components and/or materials to be treated

4. Plasma jets

5. Flat water-cooled diaphragm

6. Resulting plasma stream

7. Magnetic system

8. Circular aperture in diaphragm

9. Gas introduction nozzles

Figure 2A:
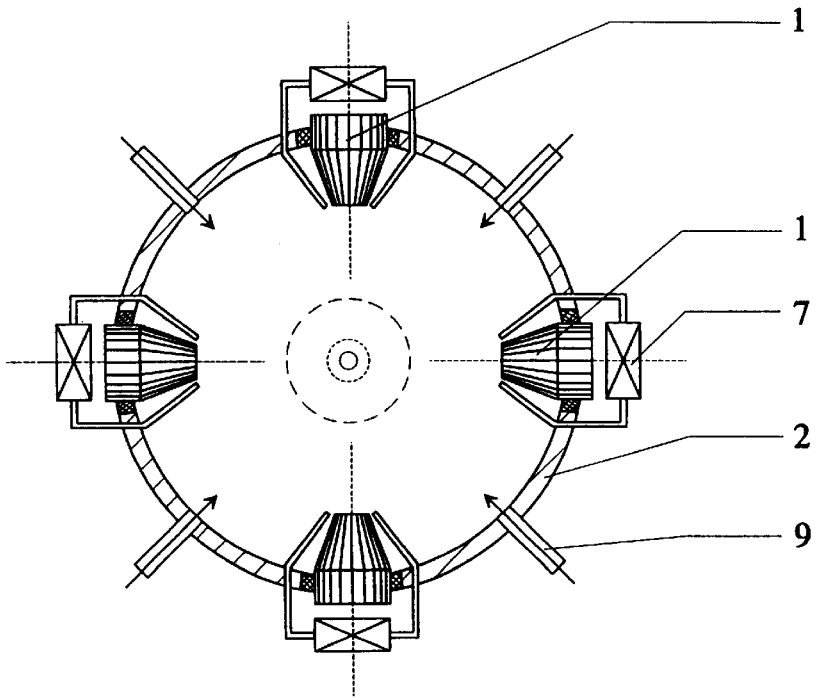
Figure 2B:
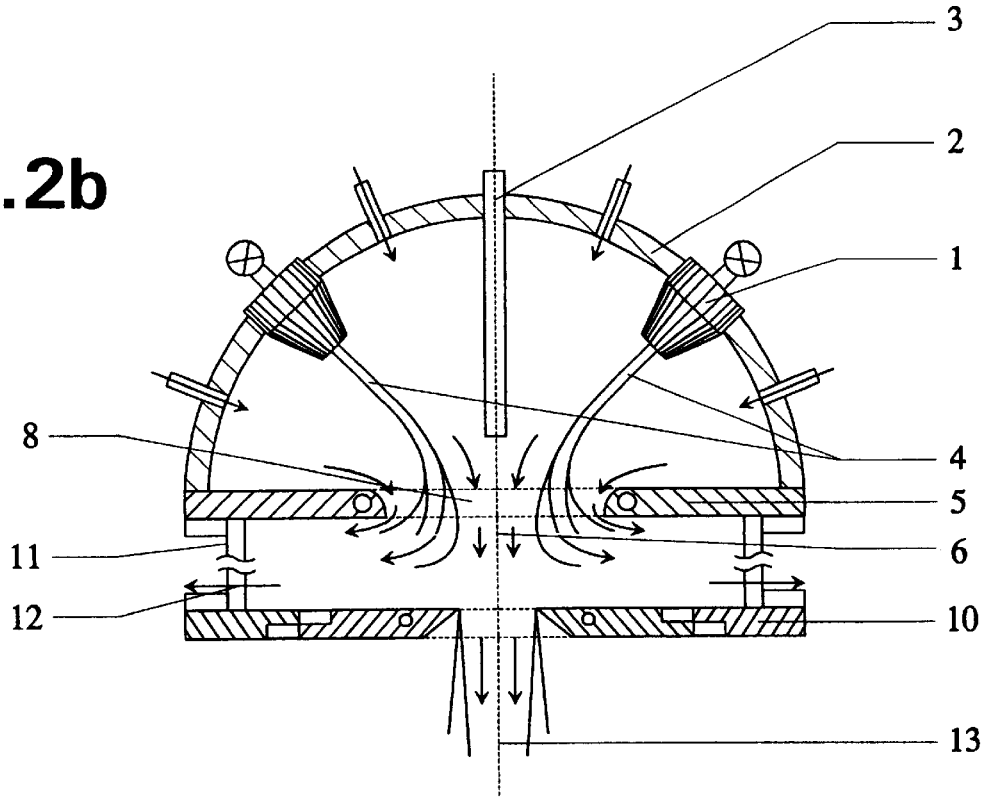

FIGS. 2*a* and 2*b* show a second example of the generator as per the invention, in a view from the side of the diaphragm (with the diaphragms shown by a broken line) and a lateral section, respectively; the references relating to these two figures are as follows

1. Electrode chamber

2. Concave flange of the enclosure, water-cooled

3. Nozzle for introducing chemical components and/or materials to be treated

4. Plasma jets

5. Flat water-cooled diaphragm

6. Resulting plasma stream

7. Magnetic system

8. Circular aperture in diaphragm

9. Gas introduction nozzles

10. Second water-cooled adjustable diaphragm

11. Circular wall

12. Evacuation aperture for plasma and gas introduced into the enclosure

13. Resulting jet of activated gas

Figure 3:
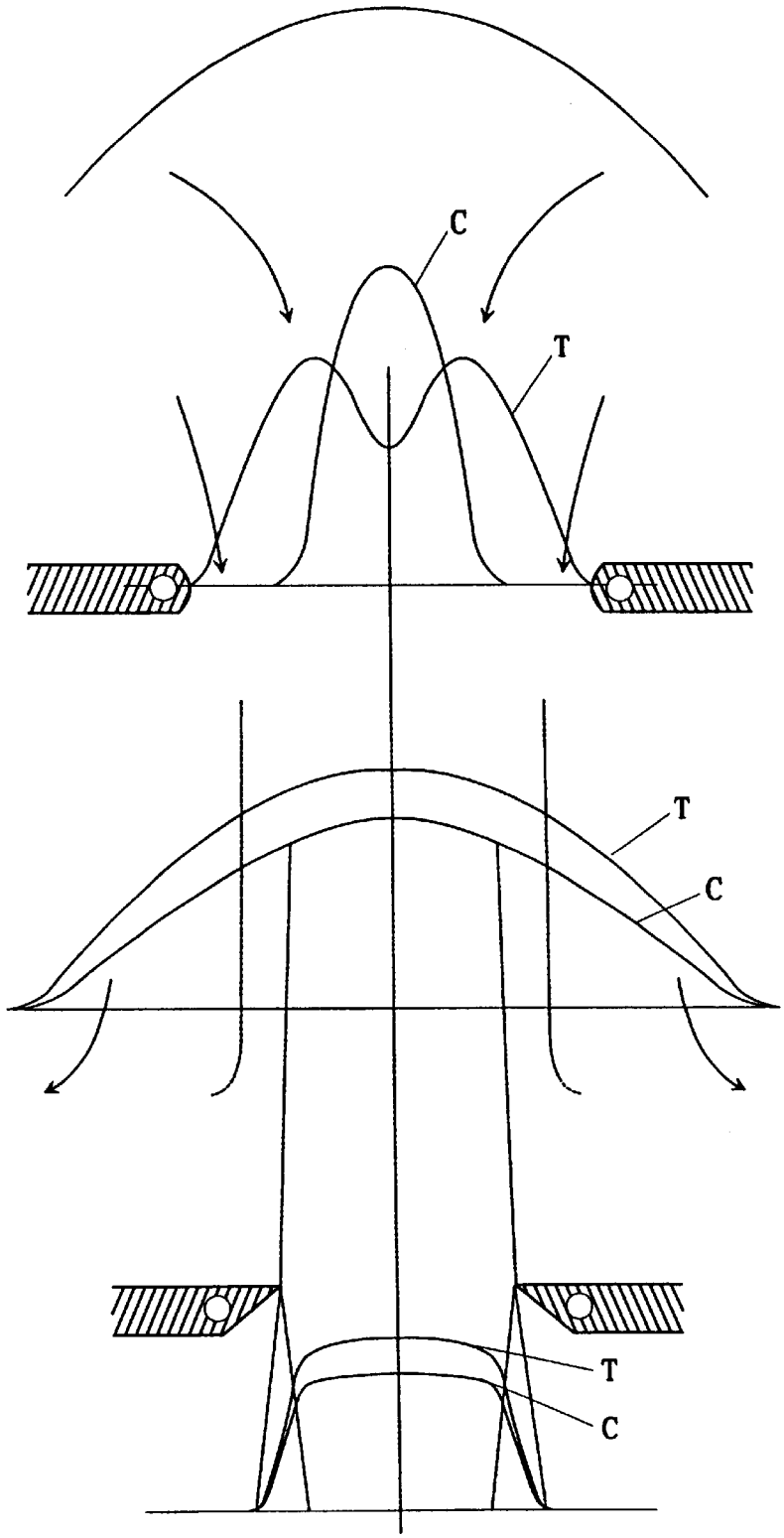

FIG. 3 is a diagram illustrating operation of the diaphragms according to the temperature distribution (T) and the composition (C) of the stream from the generator, at different distances from the electrode chambers.

DESCRIPTION OF THE PREFERRED EMBODIMENTS

The four-nozzle generators shown in FIGS. 1*a*, 1*b*, 2*a* and 2*b* comprise, as in the known prototype described above, four electrode chambers 1, a magnetic system 7 for controlling the shape and trajectory of the plasma jets 4, a pipe for introducing chemical components and/or products to be activated in the plasma funnel. The new element in the generator construction is the enclosure, aerated by a gas introduced via the nozzles 9, and to which the electrode chambers 1 are fixed.

The enclosure consists of a water-cooled concave flange and a system of water-cooled diaphragms.

Figure 1B:
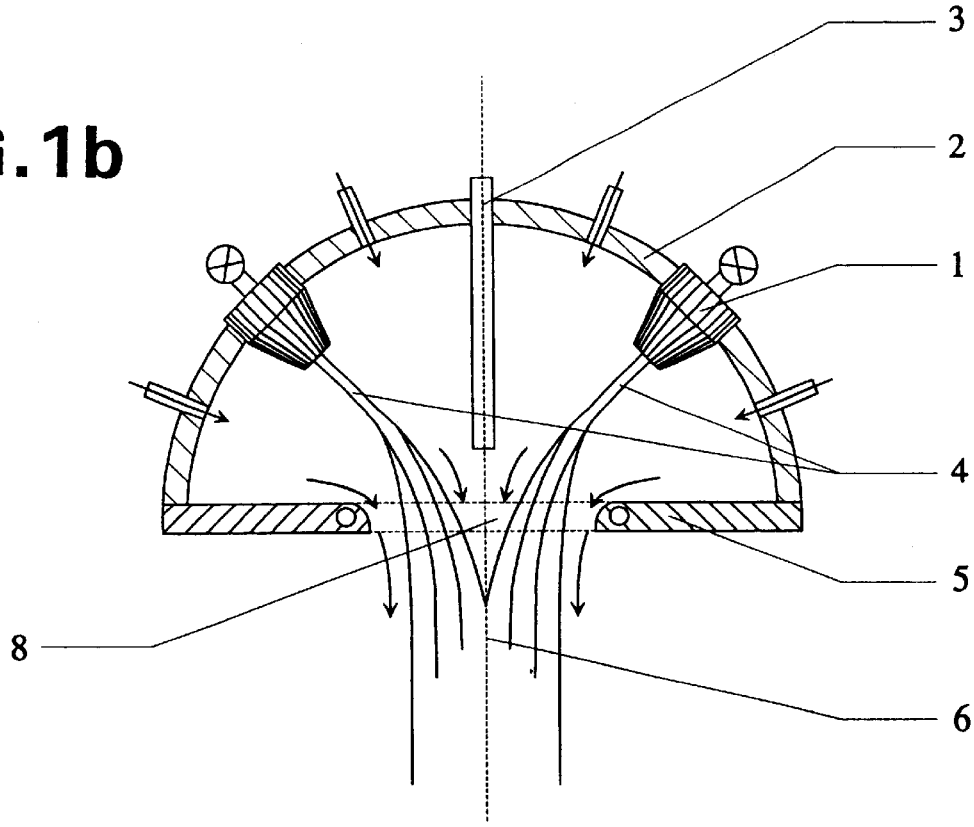

FIGS. 1*a* and 1*b* show the embodiment in which the diaphragm system comprises a diaphragm in the form of a cooled annular flange 5, of internal diameter such that it allows the plasma stream to flow through, in which the products to be activated are introduced via the nozzle 3, and the peripheral stream of gas introduced into the enclosure via the nozzles 9.

This gas stabilises the plasma stream and prevents vortices from forming and their contact with the electrode chambers, their fixings and supply elements. The plasma jets from the electrode chambers converge and join in the plane of the diaphragm 8. The accompanying gas stream, which passes peripherally through the aperture of the diaphragm 5 stabilises the plasma stream, reducing the degree to which the plasma mixes with the surrounding gases, and reducing the transfer of radical heat from the plasma stream, which elongates the resulting plasma jet. The diaphragm 5 whose aperture 8 is relatively small, substantially reduces radiation from the plasma stream 6 in the direction of the electrode chambers.

FIGS. 2*a* and 2*b* illustrate the embodiment in which the diaphragm system comprises not only the diaphragm 5 whose functions are described above, but also a water-cooled diaphragm 10 with an adjustable aperture of smaller diameter than that of the plasma stream, and which only allows the activated gas stream to pass through.

The diaphragm 10 is fixed to the enclosure by means of a circular wall 11. Gas from the nozzles (9) and the activating plasma are evacuated via apertures 12. This diaphragm enables elimination of the peripheral plasma gases and the accompanying gases which hinder the diffusion of activated particles to the surface to be treated. As the diagram in FIG. 3 shows, the diaphragm 10 also ensures uniform distribution of temperature and composition of the activated stream issued from the proposed generator.

What is claimed is:

1. A four-nozzle plasma generator comprising two anode electrode chambers and two cathode electrode chambers connected to DC power sources and generating four plasma jets of which the shape and the trajectory are determined by an external magnetic field system, such that the plasma jets form a single plasma stream with a central zone of lowered temperature into which a chemical component and/or materials to be treated are introduced, characterized in that the electrode chambers are arranged in an enclosure having means for introducing a gas into said enclosure, this enclosure consisting of a concave flange to which the electrode chambers are fixed, said means for introducing a gas further comprising gas introduction nozzles affixed to said concave flange and arranged for providing a peripheral gas stream accompanying peripherally said plasma stream and a first flat water-cooled diaphragm provided with a central circular aperture positioned at the point of convergence of the plasma jets from the electrode chambers and through which the current passes.

2. A generator according to claim 1, wherein said means for introducing a gas into said enclosure consist of four gas introduction nozzles.

3. Generator according to claim 1, characterized in that it further comprises, downstream of the first diaphragm, a second water-cooled diaphragm, with an aperture of variable diameter, smaller than that of the plasma stream, this diaphragm being fixed to the enclosure by means of a circular wall, enabling evacuation of a part of the plasma and gases introduced into the enclosure.

4. A four-nozzle plasma generator comprising two anode electrode chambers and two cathode electrode chambers connected to DC power sources and generating four plasma jets of which the shape and the trajectory are determined by an external magnetic field system, such that the plasma jets form a single plasma stream with a central zone of lowered temperature into which a chemical component and/or materials to be treated are introduced, characterized in that the electrode chambers are arranged in an enclosure having means for introducing a gas into said enclosure, this enclosure consisting of a concave flange to which the electrode chambers and said means for introducing a gas are fixed and a first flat water-cooled diaphragm provided with a central circular aperture positioned at the point of convergence of the plasma jets from the electrode chambers and through which the current passes and in that it comprises, downstream of the first diaphragm, a second water-cooled diaphragm, with an aperture of variable diameter, smaller than that of the plasma stream, this diaphragm being fixed to the enclosure by means of a circular wall, enabling evacuation of a part of the plasma and gases introduced into the enclosure.

5. A generator according to claim 4, wherein said means for introducing a gas into said enclosure consist of four gas introduction nozzles.

6. A four-nozzle plasma generator comprising two anode electrode chambers and two cathode electrode chambers connected to DC power sources and generating four plasma jets of which the shape and the trajectory are determined by an external magnetic field system, such that the plasma jets form a single plasma stream with a central zone of lowered temperature into which a chemical component and/or materials to be treated arc introduced, characterised in that the electrode chambers are arranged in an enclosure having means for introducing a gas into said enclosure, this enclosure consisting of a concave flange to which the electrode chambers and said means for introducing a gas are fixed and a first flat water-cooled diaphragm provided with a central circular aperture positioned at the point of convergence of the plasma jets from the electrode chambers and through which the current passes; and characterised further in that it comprises, downstream of the first diaphragm, a second water-cooled diaphragm, with an aperture of variable diameter, smaller than that of the plasma stream, this diaphragm being fixed to the enclosure by means of a circular well, enabling evacuation of a part of the plasma and gases introduced into the enclosure.

* * * * *